US010036607B2

(12) United States Patent
Hiipakka

(10) Patent No.: US 10,036,607 B2
(45) Date of Patent: Jul. 31, 2018

(54) BARREL OF A GUN

(71) Applicant: Marko Hiipakka, Espoo (FI)

(72) Inventor: Marko Hiipakka, Espoo (FI)

( * ) Notice: Subject to any disclaimer, the term of this patent is extended or adjusted under 35 U.S.C. 154(b) by 0 days.

(21) Appl. No.: 15/310,810

(22) PCT Filed: May 12, 2015

(86) PCT No.: PCT/FI2015/000022

§ 371 (c)(1),
(2) Date: Nov. 14, 2016

(87) PCT Pub. No.: WO2015/173462

PCT Pub. Date: Nov. 19, 2015

(65) Prior Publication Data

US 2017/0089657 A1 Mar. 30, 2017

(30) Foreign Application Priority Data

May 14, 2014 (FI) ..... 20140142

(51) Int. Cl.
*F41A 21/48* (2006.01)
*F42B 10/26* (2006.01)

(52) U.S. Cl.
CPC ..... *F41A 21/48* (2013.01); *F42B 10/26* (2013.01)

(58) Field of Classification Search
CPC F41A 21/48; F41A 31/00; F41F 3/048; F42B 10/26; F41B 11/00
See application file for complete search history.

(56) References Cited

U.S. PATENT DOCUMENTS

| | | | | |
|---|---|---|---|---|
| 2,406,089 A | | 8/1946 | Martineau | |
| 2,863,375 A | * | 12/1958 | Long | A23L 7/178 220/314 |
| 3,217,568 A | * | 11/1965 | De Graffenried | B23Q 11/08 408/13 |
| 3,820,705 A | * | 6/1974 | Beals | B25C 1/005 227/110 |
| 4,644,930 A | * | 2/1987 | Mainhardt | F41A 11/02 124/58 |
| 5,042,360 A | * | 8/1991 | Burmeister | F41A 7/10 89/12 |
| 5,096,741 A | * | 3/1992 | Kobayashi | C09D 5/086 427/127 |
| 5,189,244 A | | 2/1993 | Weldon | |
| 5,564,717 A | * | 10/1996 | Alberts | B23B 31/00 279/145 |
| 6,152,125 A | * | 11/2000 | Piper | F41A 9/36 124/59 |
| 2004/0083639 A1 | | 5/2004 | Strayn | |
| 2006/0000136 A1 | | 1/2006 | Young | |
| 2014/0023985 A1 | * | 1/2014 | Menassa | A61M 5/2053 433/90 |
| 2017/0205165 A1 | * | 7/2017 | Furusho | F41A 5/10 |

* cited by examiner

*Primary Examiner* — Michael D David
(74) *Attorney, Agent, or Firm* — Seppo Laine Oy

(57) ABSTRACT

A gun barrel that consists of a frame tube that encloses a barrel tube that is used to induce rotation to a projectile. The gun barrel as a whole constitutes an electric motor. The barrel tube is a permanent magnet and acts as the rotor of the motor. The stator coils of the motor are located outside the barrel tube and are used to induce rotation to the rotor, i.e., the barrel tube.

7 Claims, 1 Drawing Sheet

BARREL OF A GUN

The present invention relates to a barrel of a gun that consists of a frame tube that encloses a barrel tube that induces rotation to a projectile.

BACKGROUND ART

In the traditional solution the angular velocity is induced by the spiral grooves (rifles) in the inner wall of the borehole of the gun barrel. The angular velocity, which is a function of the forward velocity of the projectile, accelerates from zero to its maximum on its way from the chamber to the muzzle of the gun barrel.

DRAWBACKS IN BACKGROUND ART

The rifles cause additional friction between the projectile and the gun barrel, which increases the amount of energy needed to accelerate the projectile to the desired muzzle velocity. The angular velocity of the projectile is proportional to its forward velocity, which means that to achieve sufficient angular velocity the forward velocity, too, has to be large enough. Said angular velocity cannot be adjusted or chosen freely as it depends on the structure of the gun barrel and its rifles. Rifling is a cumbersome and expensive part of the manufacturing process of gun barrels. The gun barrel bends during the rifling and it has to be straightened afterwards. In addition, when used, the rifles are worn out, which shortens the life span of the gun barrel.

Publication U.S. Pat. No. 2,406,089 describes a gun barrel, the inner pipe of which is rotated by beans of a mechanical apparatus, that includes such a large amount of moving parts and cogwheels that a sufficient angular velocity is not achievable.

SUMMARY

The present invention is characterized by the gun barrel as a whole constituting an electric motor such that the barrel tube is a permanent magnet acting as the rotor of said motor, and that the coils of the stator of said motor are located outside the rotor and are used to induce the rotation of the rotor, i.e., the barrel tube of the gun barrel.

Different embodiments of the invention are presented in the dependent patent claims.

The basic idea of the invention is that the projectile of a gun, pistol, artillery gun, etc. is rotated before the release using a smoothbore barrel tube having an extremely large angular velocity. At the release the barrel tube and the projectile have identical angular velocities. Due to the absence of rifles in the barrel tube there is no excess friction between the projectile and the barrel tube in the forward direction. Thus, a larger forward velocity is obtained with less energy. The rotation of the barrel tube is achieved such that the gun barrel as a whole constitutes an electric motor. The middle part of the gun barrel is built as a permanent magnet that acts as the rotor of an electric motor having an extremely large angular velocity (e.g. 70,000-250,000 rounds per minute). The large rotational speed is reached for a short moment just prior to the release. After release, any backward or forward movement of the barrel tube is hindered by using a suspension mechanism that includes ball bearings.

BENEFITS

Compared to the traditional method the desired muzzle velocity is achieved using a smaller amount of gunpowder, or a larger muzzle velocity using the same amount of gunpowder. Better accuracy and longer reach is thereby achieved for the projectile. The angular velocity of the projectile can be chosen arbitrarily depending on current needs. A large angular velocity will bring 25 more stability and accuracy while a smaller angular velocity will allow the projectile to turn so as to be aligned with its ballistic path. By means of the present invention it is possible to achieve large angular velocities even with small forward velocities. A smooth bore pipe will not ware out as fast as a rifled one. A smooth bore pipe can be manufactured inherently very straight, which means that it can be shorter than traditional gun barrels. A gun can be made quieter using the present invention due to smaller amounts of gunpowder needed.

BRIEF DESCRIPTION OF THE DRAWINGS

The invention is described below by means of an example and referring to the attached drawing, where.

DETAILED DESCRIPTION

Figure 1:
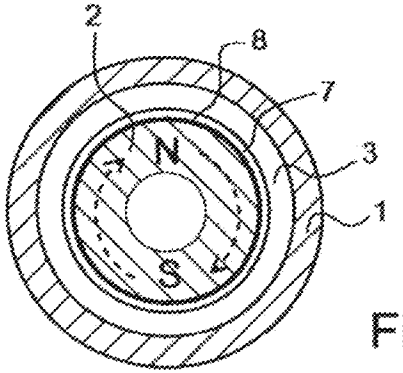
FIG. 1 depicts the cross-section of the gun barrel.
Figure 2:
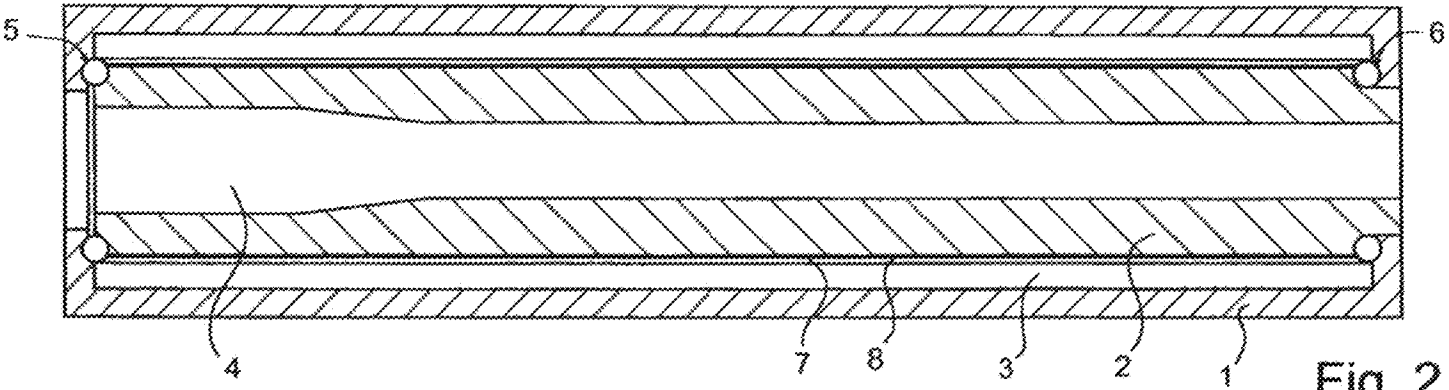
FIG. 2 depicts the longitudinal section of the gun barrel.

The gun barrel consists of a frame tube 1 that encloses the smoothbore steel tube 2 that is used to induce rotation to the projectile. The gun barrel as a whole constitutes an electric motor such that the barrel tube 2 is a permanent magnet and acts as the rotor of the electric motor; and that the stator coils 3 of said motor are located outside the barrel tube 2 and are used to induce rotation to the barrel tube 2. The frame tube 1 that is located outside the stator 3 acts as the frame of the stator. The chamber 4 of the gun barrel is a part of the rotating barrel tube. The cartridge, after being placed inside the chamber, reaches the desired angular velocity prior to the release.

The barrel tube is supported from the front and from behind with ball bearings. The barrel tube has to be supported from the middle, too, with one or several ball bearings. (not presented in figure)

There is an air gap 7 between the stator 3 and the rotor 2. The rotor 2 is 15 equipped with a titanium jacket 8 that supports and protects it from mechanical stress.

The gun barrel is attached to the bolt mechanism of the gun, e.g., by using external screw threads. A gun barrel without said external screw threads can be attached to the gun, e.g., by using a press connection mechanism in the bolt mechanism. The material of the frame tube can be some suitable steel or aluminum alloy or, e.g., glass or carbon fiber. The jacket of the rotor can be made not only of titanium, but also of copper or some other suitable metal alloy.

The invention claimed is:

1. A gun barrel comprising a frame tube that encloses a barrel tube that is used to induce rotation to a projectile, wherein, the gun barrel as a whole constitutes an electric motor such that:

the barrel tube is a permanent magnet and acts as the rotor of said electric motor, and the gun barrel further comprises stator coils surrounding the barrel tube, said stator coils being configured to induce rotation to the rotor.

2. The gun barrel according to claim 1, wherein, a frame tube that acts as a frame for the stator coils is located outside the stator coils.

3. The gun barrel according to claim 1, wherein, a chamber of the gun barrel is a part of the rotating barrel tube.

4. The gun barrel according to claim 1, wherein, the barrel tube is supported from the front and from the behind with ball bearings.

5. The gun barrel according to claim 1, wherein, an air gap is located between the stator coils and the barrel tube acting as the rotor of the electric motor.

6. The gun barrel according to claim 1, wherein, the barrel tube acting as a rotor is equipped with a titanium jacket.

7. A gun barrel comprising:

a frame tube, a barrel tube enclosed within the frame tube, and stator coils affixed to the frame tube such that the stator coils surround the barrel tube, wherein the barrel tube is a permanent magnet such that the barrel tube acts as a rotor in an electric motor comprised of the barrel tube and stator coils.

* * * * *